US005836448A

United States Patent [19]

Weder

[11] Patent Number: 5,836,448

[45] Date of Patent: Nov. 17, 1998

[54] SHIPPING DEVICE WITH BONDABLE FOAM LAYER

[75] Inventor: Donald E. Weder, Highland, Ill.

[73] Assignee: Southpac Trust International, Inc.

[21] Appl. No.: 796,489

[22] Filed: Feb. 5, 1997

[51] Int. Cl.[6] ..... B65D 85/50; B65D 85/52

[52] U.S. Cl. ..... 206/423; 206/523; 206/813; 53/472

[58] Field of Search ..... 206/423, 523, 206/593, 594, 499, 460, 813; 53/472, 447, 390

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren . | |
| 2,373,634 | 4/1945 | Wagner . | |
| 2,578,583 | 12/1951 | O'Brien . | |
| 2,664,670 | 1/1954 | Mulford . | |
| 2,707,352 | 5/1955 | Fischer . | |
| 2,721,022 | 10/1955 | Billerbeck . | |
| 2,744,624 | 5/1956 | Hoogstoel et al. . | |
| 2,871,080 | 1/1959 | Shelly . | |
| 2,887,220 | 5/1959 | Hankus | 206/423 |
| 3,113,673 | 12/1963 | Stein . | |
| 3,322,323 | 5/1967 | Green et al. . | |
| 3,374,884 | 3/1968 | Chinkes . | |
| 3,389,784 | 6/1968 | Hendricks et al. . | |
| 3,466,214 | 9/1969 | Polk et al. . | |
| 3,708,946 | 1/1973 | Cahill . | |
| 3,725,188 | 4/1973 | Kalt | 206/523 |
| 3,734,280 | 5/1973 | Amneus et al. . | |
| 3,754,642 | 8/1973 | Stidolph . | |
| 3,883,990 | 5/1975 | Stidolph . | |
| 3,924,354 | 12/1975 | Gregoire . | |
| 4,053,049 | 10/1977 | Beauvais . | |
| 4,170,301 | 10/1979 | Jones et al. . | |
| 4,396,120 | 8/1983 | Morita . | |
| 4,470,508 | 9/1984 | Yen . | |
| 5,065,922 | 11/1991 | Harris . | |
| 5,092,465 | 3/1992 | Weder et al. . | |
| 5,111,638 | 5/1992 | Weder . | |
| 5,148,918 | 9/1992 | Weder et al. . | |
| 5,196,637 | 3/1993 | Weder . | |
| 5,226,557 | 7/1993 | Nelson | 206/523 |
| 5,240,109 | 8/1993 | Weder et al. . | |
| 5,255,784 | 10/1993 | Weder et al. . | |
| 5,311,992 | 5/1994 | Weder et al. . | |
| 5,322,181 | 6/1994 | Nelson | 296/523 |
| 5,407,072 | 4/1995 | Weder et al. . | |
| 5,411,137 | 5/1995 | Weder et al. . | |
| 5,522,205 | 6/1996 | Weder . | |
| 5,584,392 | 12/1996 | Weder et al. | 206/423 |

FOREIGN PATENT DOCUMENTS

| | | |
|---|---|---|
| 192843 | 11/1957 | Austria . |
| 2221936 | 10/1974 | France . |
| 2735225 | 4/1978 | Germany . |
| 61058 | of 1989 | Japan . |
| 4352664 | 12/1992 | Japan . |
| 26878 | 11/1913 | United Kingdom . |

OTHER PUBLICATIONS

Oasis Grower Products; Smithers–Oasis; Kent, OH; 1991.

*Primary Examiner*—Paul T. Sewell
*Assistant Examiner*—Nhan T. Lam
*Attorney, Agent, or Firm*—Dunlap & Codding, P.C.

[57] ABSTRACT

A method and apparatus for preparing an item or plurality of items for shipment. Disposing one or a plurality of items on a rigid surface having a deformable foam layer with a bonding material thereon wherein the items are connectingly bonded to the foam layer which is deformed in response to the items. The items may be items of china, floral containers, and flower pots, or other similar items.

36 Claims, 1 Drawing Sheet

SHIPPING DEVICE WITH BONDABLE FOAM LAYER

STATEMENT REGARDING FEDERALLY SPONSORED RESEARCH OR DEVELOPMENT

Not Applicable

BACKGROUND

The present invention is related to methods for transporting various items such as floral containers and china, wherein the items are bondingly connected to a surface having a bonding layer thereon for minimizing movement and disturbance of the items during transportation.

DESCRIPTION OF THE PREFERRED EMBODIMENTS

Figure 1:
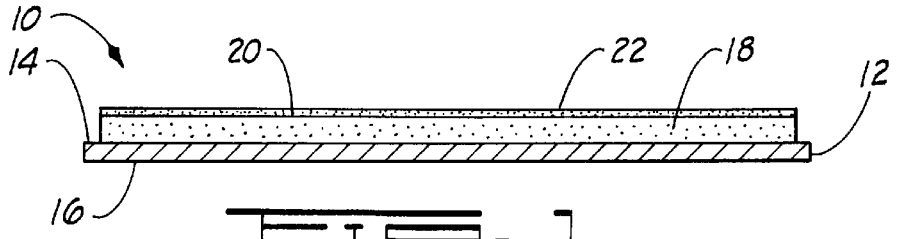
FIG. 1 is a side view of a shipping device constructed for use in accordance with the present invention.

Shown in FIG. 1 and designated by the general reference numeral 10 is a shipping device constructed in accordance with the present invention. The shipping device 10 comprises a rigid or semi-rigid support surface 12 which has an upper surface 14 and a lower surface 16. A layer of foamed material (foam layer) 18 is connected to the upper surface 14 of the support surface 12. The foam layer 18 has an upper surface 20. In a preferred version of the invention a layer of connecting bonding material 22 is disposed upon the upper surface 20 of the foam layer 18. The bonding material 22 is generally not a completely discrete layer but at least partially infiltrates into an upper portion of the foam layer 18, and may extend well into the foam layer 18. The items contained within the shipping assembly are rendered substantially immobile upon the shipping device 12, and may be further cushioned, protected, or immobilized by packing material (not shown) disposed within the interstices of the shipping assembly 26. Such packing materials are well known to those of ordinary skill in the art. In an alternate embodiment the bonding material may be dispersed throughout the cells of the foam comprising the foam layer 18 so there is not a discrete layer of bonding material which comprises the connecting bonding material 22. Included in this alternative embodiment are versions of foam which have inherently adhesive properties.

The support surface 12 may be any shape which functions in accordance with the present invention. The support surface 12, may, for example, be square, rectangular, circular or any other geometric shape which enhances the function of the sheet for the purpose disclosed herein. The support surface 12 may be cardboard, wood, metal, plastic, resin, or any rigid or semi-rigid material. The support surface 12 may be the bed of a truck. The support surface 12 may be a laminar combination of any of the above materials. Any thickness of the support surface 12 may be utilized in accordance with the present invention as long as the support surface 12 functions to support the objects disposed thereupon.

The object supported by the support device 10 may be china, a vase, or flower pot or a vase or flower pot containing a floral grouping. As used herein, the term china includes everyday dishes, cups, plates, bowls, vases, trays, pitchers and other similar household table items and may be made from plastic, ceramic, glass, metal, porcelain or other materials used to manufacture such items. Vase or flower pot refers to any type of container used for holding the floral grouping or single floral cuttings. "Floral grouping" as used herein means cut fresh flowers, artificial flowers, a single flower either fresh and/or artificial plants or other floral materials and may include other secondary plants and/or ornamentation or artificial or natural materials which add to the aesthetics of the overall floral arrangement. The floral grouping generally comprises a bloom or foliage portion and a stem portion. However, it will be appreciated that the floral grouping may consist of only a single bloom or only foliage (not shown). The term "floral grouping" may be used interchangeably herein with the term "floral arrangement".

As used herein the term "foam" means a three-dimensional porous material having a reticulated configuration in cross section and which is pliable and conformable. Examples of foams are open cell polyurethane foams, PVA foam, and Hypol foam. Preferably the foam has a relatively consistent density and thickness. Foam materials which may be used in the present invention are commercially available from various sources, such as that sold under the designation SIFZ Felted foam #2 obtainable from Foamex, Inc.; Crest Felted S-90Z, firmness 2 polyurethane foam distributed by Great Western; a microcellular hydrophilic polyurethane manufactured by Time Release Science and distributed by Truly Magic Products Inc.; PVA foam E-1 or E-2 distributed by Rippey Corp.; Hypol foam (2002, 2000, or 3000) produced by Hampshire Chemical Inc.; Acquell and hydrophilic foam manufactured by Foamex Foam Inc., #T70 foam produced by Crown Product Corp., and Bio-Foam available from Smithers Bio-Medical Systems of Kent, Ohio. Deformable styrofoams may also be used.

An example of a bonding material which may be applied to the upper surface 20 of the foam layer 18 is Adhesive #9211 available from Dyna-Tech Adhesives of Grafton, W.Va. As will be readily appreciated by one of ordinary skill in the art, any number of adhesive or cohesive bonding materials are commercially available which would function in accordance with the present invention, as long as they adhere to the foam layer and to the object disposed thereon.

The term"bonding material or bonding means" when used herein means an adhesive, frequently a pressure sensitive adhesive, or a cohesive or any other bonding material which functions as a bonding material in accordance with the invention described herein. When the bonding material is a cohesive, a similar cohesive material must be present on a surface of the object which will be disposed on the bonding surface of the shipping,device. Preferably, when the bonding material is an adhesive, the cohesive forces between adhesive molecules within the foam are stronger than the adhesive forces between the adhesive and the item placed thereon so that when the item is removed from the foam a minimum of adhesive is left on the item.

Figure 2:
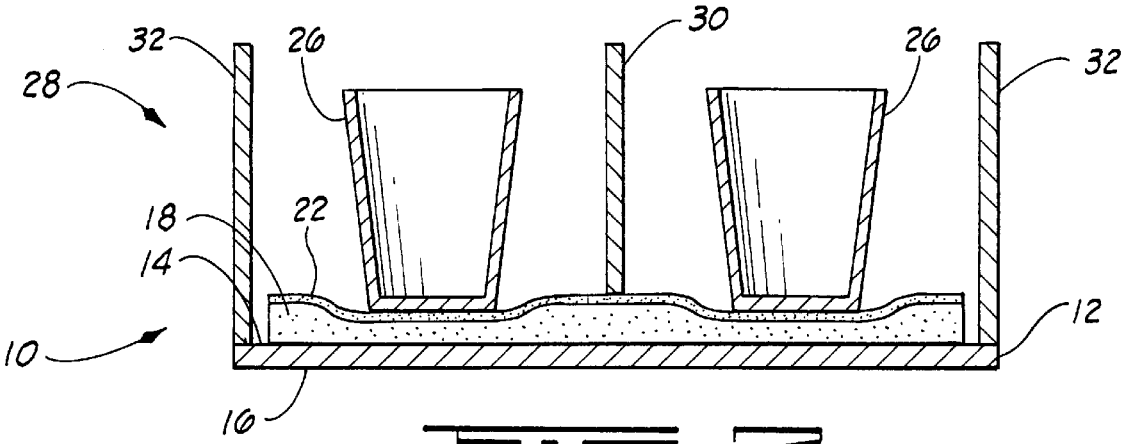
FIG. 2 is a side view of a shipping assembly constructed in accordance with the present invention.

Shown in FIG. 2 is a plurality of containers 26 bondingly connected to the shipping device 10 via the connecting bonding material 22 disposed on the foam layer 18. The containers 26 and the shipping device 10 together constitute a shipping assembly 28 which may be used to ship the containers 26 to a predetermined location. Each container 26 is anchored or secured to the shipping device 10 via the bonding material 22 and is cushioned and stabilized by the foam layer 18. When the container 26 is placed upon the shipping device 10, the container 26 deforms a portion of the foam layer 18 upon which the container 26 rests, as indicated in FIG. 2. The foam layer 18 thereby at least partially conforms to the shape of the container 26 for enhancing the bonding connection between the foam layer 18 and the container 26. Preferably the foam layer 18 returns to its original shape when the container 26 is removed from the foam layer 18 after shipping. It will be appreciated by one of ordinary skill in the art that the container shape displayed herein is but one of the great variety of shapes of objects, items or containers which may be used in accordance with the present invention. The bonding material 22 may have a release layer disposed thereon for maintaining the bonding properties of the bonding material and is removed prior to use of the device 10.

Also shown in the shipping assembly 28 in FIG. 2 is an optional partition 30 (also referred to as an insert) which is disposed between or over the objects disposed upon the shipping device. Also shown in the shipping assembly 28 in FIG. 2 are optional sidewalls 32 which extend vertically from the support surface 12 surrounding the foam layer 18 and which at least partially enclose a space within which the containers reside. The shipping assembly 26 may further comprise a lid (not shown). Although the foam layer 18 is indicated in FIGS. 1–2 as comprising a continuous layer, the foam layer 18 may instead be disposed upon the support surface 12 in any functional geometric form or pattern including spots, designs, strips, or squares.

The term "floral grouping" when used herein generally means a plant having a bloom portion and a stem portion. Further, the floral grouping 34 may comprise a root portion (not shown) as well. However, it will be appreciated that the floral grouping may consist of only a single bloom or only foliage, or a botanical item (not shown), or a propagule (not shown). The term "floral grouping" may also be used interchangeably herein with the terms "botanical item" and/or "propagule" and may include a plant having only foliage and no blooms.

The term "growing medium" when used herein means any liquid, solid or gaseous material used for plant growth or for the cultivation of propagules, including organic and inorganic materials such as soil, humus, perlite, vermiculite, sand, water and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

Figure 3:
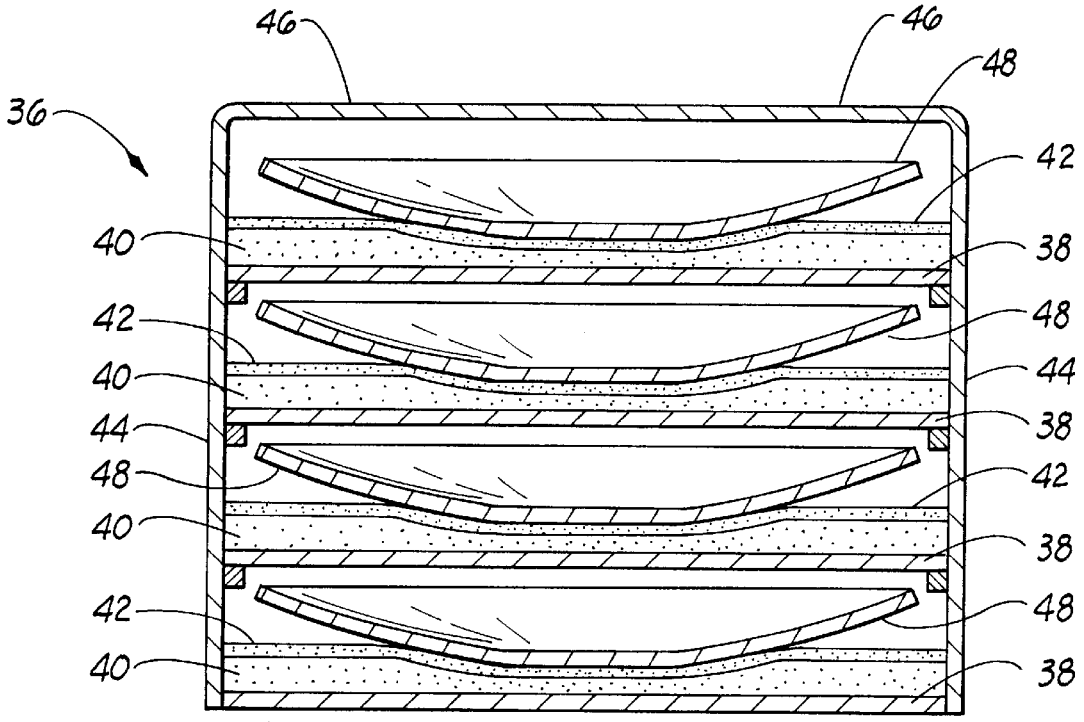
FIG. 3 is a side view of another shipping assembly constructed in accordance with the present invention.

An alternative version of the present invention, shown in FIG. 3, is a shipping assembly designated by the general reference numeral 36. The shipping assembly 36 has a plurality of interior support surfaces 38, each having a deformable foam layer 40 exactly the same as described above and each having a connecting bonding material 42 disposed thereon. The assembly 36 may comprise a plurality of side walls 44 and upper flaps 46 which are shown in FIG. 3 in a closed position but when lifted in an outward direction can be opened into an open position. Each support surface 38 holds at least one item 48, as described earlier; the item 48 disposed on the foam layer 40 and connected thereto via the bonding material 42, exactly as described above for the shipping assembly 28.

Changes may be made in the construction and the operation of the various components, elements and assemblies described herein or in the steps or the sequence of steps of the methods described herein without departing from the spirit and scope of the invention as defined in the following claims.

What is claimed is:

1. A method of preparing an item for shipment, comprising:

providing a shipping device comprising a rigid support surface at least a portion of which has a deformable foam layer disposed thereupon and connected thereto, the deformable foam layer having an upper bonding surface comprising a connecting bonding material; and securing at least one item to the shipping device by placing the item upon the foam layer of the shipping device and bondingly connecting the item to the foam layer via the connecting bonding material wherein a portion of the foam layer adjacent the item is deformed in response to pressure exerted on the foam layer by the item wherein the foam layer conforms to a portion of the item such that the item is secured for shipment.

2. The method of claim 1 wherein in the step of providing the shipping device the bonding material is an adhesive.

3. The method of claim 1 wherein in the step of placing the item, the item comprises a connecting bonding material disposed upon a portion thereof for cooperating with the connecting bonding material of the foam layer to bondingly connect the item to the foam layer.

4. The method of claim 3 wherein in the step of providing the shipping device and placing the item, the connecting bonding material of the foam layer and the connecting bonding material of the item are cohesive materials.

5. The method of claim 1 wherein in the step of providing the shipping device, the shipping device further comprises a plurality of side walls attached to the rigid support surface and surrounding the deformable foam layer.

6. The method of claim 1 comprising the additional step of positioning a partition adjacent the at least one item bondingly connected to the foam layer of the shipping device.

7. The method of claim 1 wherein in the step of placing the item, the item is an item of china.

8. The method of claim 1 wherein on the step of placing the item, the item is a floral container.

9. The method of claim 8 wherein the floral container contains a floral grouping disposed therein.

10. The method of claim 1 further comprising the step of transporting the shipping device and the at least one item secured thereto to a predetermined destination.

11. A shipping device, comprising:

a rigid support surface;

a deformable foam layer disposed upon at least a portion of the rigid support surface and connected thereto; and an upper bonding surface of the deformable foam layer comprising a connecting bonding material for bondingly connecting at least one item to the foam layer and wherein a portion of the foam layer adjacent the item is deformed in response to pressure exerted on the foam layer by the item when the item is placed upon the foam layer wherein the foam layer conforms to a portion of the item for securing the item to the shipping device for shipment.

12. The shipping device of claim 11 wherein the connecting bonding material is an adhesive or cohesive.

13. The shipping device of claim 11 further comprising a partition for being positioned adjacent the item placed upon the shipping device.

14. The shipping device of claim 11 further comprising a plurality of side walls attached to the rigid support surface and surrounding the deformable foam layer.

15. The shipping device of claim 11 wherein the rigid support surface is constructed from the group consisting of cardboard, wood, metal, glass, plastic, thermoplastics, fiberglass, and resins.

16. A shipping assembly, comprising:

a shipping device comprising a rigid support surface at least a portion of which has a deformable foam layer disposed thereupon and connected thereto, the deformable foam layer having an upper bonding surface comprising a connecting bonding material; and at least one item placed upon the foam layer of the shipping device and bondingly connected to the foam layer via the connecting bonding material wherein a portion of the foam layer adjacent the item is deformed in response to pressure exerted on the foam layer by the item wherein the foam layer conforms to a lower end of the item such that the item is secured to the device for shipment.

17. The shipping device of claim 16 wherein the connecting bonding material is an adhesive.

18. The shipping device of claim 16 further comprising a partition positioned adjacent the item placed upon the shipping device.

19. The shipping device of claim 16 further comprising a plurality of side walls attached to the rigid support surface and surrounding the deformable foam layer.

20. The shipping assembly of claim 16 wherein the item comprises a connecting bonding material disposed thereon for cooperating with the connecting bonding material of the foam layer to bondingly connect the item to the foam layer.

21. The shipping assembly of claim 20 wherein the connecting bonding material of the foam layer and the connecting bonding material of the item are cohesive bonding materials.

22. The shipping assembly of claim 16 wherein the item is a floral container.

23. The shipping assembly of claim 22 wherein the floral container contains a floral grouping disposed therein.

24. The shipping assembly of claim 16 wherein the item is an item of china.

25. The shipping assembly of claim 16 wherein the rigid support surface is constructed from the gravy consisting of cardboard, wood, metal, glass, plastic, thermoplastics, fiberglass, and resins.

26. A method of preparing a floral grouping for shipment, comprising:

providing a shipping device comprising a rigid support surface at least a portion of which has a deformable foam layer disposed thereupon and connected thereto, the deformable foam layer having an upper bonding surface comprising a connecting bonding material; and securing at least one floral container having a lower end and having a floral grouping therein to the shipping device by placing the floral container upon the foam layer of the shipping device and bondingly connecting the lower end of the floral container to the foam layer via the connecting bonding material wherein a portion of the foam layer adjacent the item is deformed in response to pressure exerted on the foam layer by the floral container wherein the foam layer conforms to the lower end of the floral container such that the floral container is secured for shipment.

27. The method of claim 26 wherein in the step of providing the shipping device the bonding material is an adhesive.

28. The method of claim 26 wherein in the step of placing the floral container, the floral container comprises a connecting bonding material disposed upon a portion thereof for cooperating with the connecting bonding material of the foam layer to bondingly connect the lower end of the floral container to the foam layer.

29. The method of claim 28 wherein in the step of providing the shipping device and placing the floral container, the connecting bonding material of the foam layer and the connecting bonding material of the floral container are cohesive materials.

30. The method of claim 26 further comprising the step of transporting the shipping device and the floral container secured thereto to a predetermined destination.

31. The shipping device of claim 26 wherein the rigid support surface is constructed from the group consisting of cardboard, wood, metal, glass, plastic, thermoplastics, fiberglass, and resins.

32. A shipping assembly, comprising:

a shipping device comprising a rigid support surface at least a portion of which has a deformable foam layer disposed thereupon and connected thereto, the deformable foam layer having an upper bonding surface comprising a connecting bonding material; and at least one floral container having a lower end and having a floral grouping therein placed upon the foam layer of the shipping device and the lower end of the floral container is bondingly connected to the foam layer via the connecting bonding material wherein a portion of the foam layer adjacent the lower end of the floral container is deformed in response to pressure exerted on the foam layer by the floral container wherein the foam layer conforms to the lower end of the floral container such that the floral container is secured to the device for shipment.

33. The shipping device of claim 32 wherein the connecting bonding material is an adhesive.

34. The shipping assembly of claim 32 wherein the floral container comprises a connecting bonding material disposed thereon for cooperating with the connecting bonding material of the foam layer to bondingly connect the lower end of the floral container to the foam layer.

35. The shipping assembly of claim 34 wherein the connecting bonding material of the foam layer and the connecting bonding material of the floral container are cohesive bonding materials.

36. The shipping assembly of claim 32 wherein the rigid support surface is constructed from the group consisting of cardboard, wood, metal, glass, plastic, thermoplastics, fiberglass, and resins.

* * * * *